US005718640A

United States Patent [19]

Noblin

[11] Patent Number: 5,718,640

[45] Date of Patent: Feb. 17, 1998

[54] GOLF SWING TRAINING DEVICE

[76] Inventor: John S. Noblin, 10425 Jordan Pkwy., Hopewell, Va. 23860-7751

[21] Appl. No.: 777,792

[22] Filed: Dec. 31, 1996

[51] Int. Cl.[6] ..... A63B 69/36

[52] U.S. Cl. ..... 473/212; 473/215; 473/409; 473/276

[58] Field of Search ..... 473/212, 213, 473/214, 215, 276, 277, 409

[56] References Cited

U.S. PATENT DOCUMENTS

| | | | |
|---|---|---|---|
| 1,699,219 | 1/1929 | Bemish et al. | 473/212 |
| 2,093,153 | 9/1937 | McCarthy | 473/212 |
| 2,773,691 | 12/1956 | Redfield . | |
| 3,069,169 | 12/1962 | Topping | 473/212 |
| 3,324,851 | 6/1967 | Posner | 473/212 |
| 5,188,365 | 2/1993 | Picard . | |

*Primary Examiner*—George J. Marlo
*Attorney, Agent, or Firm*—Cushman Darby & Cushman IP Group of Pillsbury Madison & Sutro LLP

[57] ABSTRACT

A golf swing training device includes belt structure having end portions constructed and arranged to be joined to fix the belt structure around a waist of the user. The belt structure has a central portion between the end portions. A strap member is provided and is constructed and arranged to be fitted around an arm portion of the user generally adjacent an elbow of the user. Coupling structure that includes a double swivel connector couples the strap member to the central portion of the belt structure and is constructed and arranged to restrict generally upward movement of the strap member with respect to the central portion yet permit sliding motion of the strap member along the central portion such that during a back swing of a golf swing, the strap member may slide in one direction along the central portion and during the down swing of the golf swing, the strap member may slide along a central portion in a direction opposite the one direction, with the strap member controlling movement of the elbow of the user so as to keep the elbow generally adjacent the waist of the user during the golf swing.

8 Claims, 2 Drawing Sheets

GOLF SWING TRAINING DEVICE

BACKGROUND OF THE INVENTION

The present invention relates generally to golf swing training aids, and more particularly, to a device which can control the body movements during the back swing and follow through of a golf swing.

Anyone who has attempted to hit a golf ball realizes that it is not an easy endeavor. Generally, golfers tend to practice at driving ranges by hitting a bucket of balls. While practicing, typical weekend golfers do not hit many of the balls properly and usually hit most of the balls in the bucket in attempting to determine why he/she is not hitting the balls properly. For example, the golfer may try to concentrate on watching the ball, making sure to turn the shoulders and hips, making sure not to have a "reverse weight shift", trying not to "hit from the top", trying to watch out for that "flying elbow". By the time the golfer figures out what the proper swing should be, he or she is either out of time or out of practice balls. Thus, the golfer has not only wasted the practice time, but the balls hit were hit wrong which has engraved negative swing mechanics. It would have been better to have never hit balls, than to hit the bucket of balls incorrectly.

Accordingly, a need exists to provide a golf swing training device which eliminates many of the swing problems which occur during a full golf swing.

SUMMARY OF THE INVENTION

It is an object of the invention to provide a golf swing training device to fulfill the need referred to above. In accordance with the principles of the present invention, this objective is obtained by providing a golf swing training device including belt structure having end portions constructed and arranged to be joined to fix the belt structure around a waist of the user. The belt structure has a central portion between the end portions. A strap member is provided and is constructed and arranged to be fitted around an arm portion of the user generally adjacent an elbow of the user. Coupling structure couples the strap member to the central portion of the belt structure and is constructed and arranged to restrict generally upward movement of the strap member with respect to the central portion yet permit sliding motion of the strap member along the central portion such that during a back swing of a golf swing, the strap member may slide in one direction along the central portion and during the down swing of the golf swing, the strap member may slide along a central portion in a direction opposite the one direction, with the strap member controlling movement of the elbow of the user so as to keep the elbow generally adjacent the waist of the user during the golf swing.

A method of performing a golf swing utilizing the golf training device as described above is also provided. The method includes securing the belt structure around the waist of the user; securing the strap member around an arm of the user generally adjacent the elbow; and performing a golf swing by initiating a back swing whereby the strap member slides in a first direction along the central portion of the belt structure substantially in a plane, with the strap member restricting generally upward movement of the elbow and during the down swing, the strap member slides along the plane in a direction opposite the first direction such that the elbow is kept generally adjacent the waist of the user.

Other objects, features and characteristics of the present invention, as well as the methods of operation and functions of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE INVENTION

Figure 1:
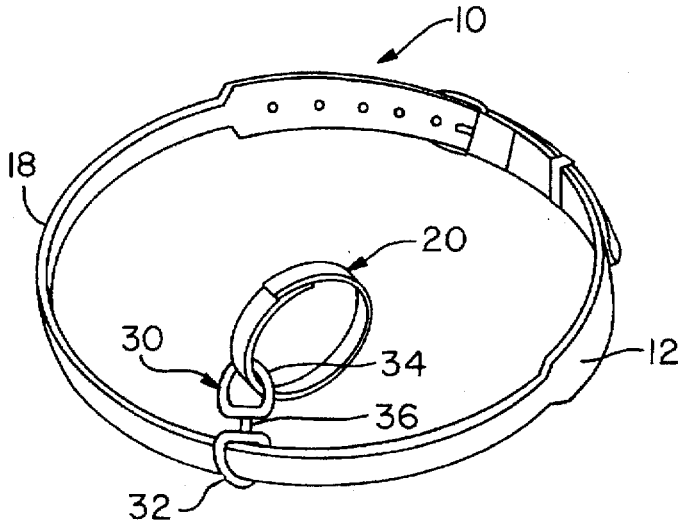
FIG. 1 is a perspective view of a golf swing training device provided in accordance with the principles of the present invention.

Referring to the drawings, a golf swing training device is shown, generally indicated at 10, which embodies the principles of the present invention.

Figure 2:
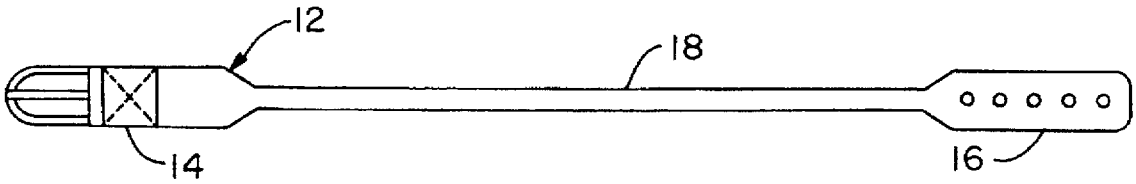
FIG. 2 is a front view of the belt portion of the device of FIG. 1.

The device 10 includes belt structure 12 having end portions 14 and 16. As shown in FIG. 2, the ends 14 and 16 are constructed and arranged to be joined to fix the belt structure 12 around a waist of a user. In the illustrated embodiment, the ends 14 and 16 are of a conventional buckle arrangement having a buckle at one end and a plurality of cooperating holes at the opposite end. It can be appreciated that any type of joining arrangement may be provided at the ends, including hook and loop type fastening. The belt structure is preferably made of nylon and includes a central portion 18 between the ends 14 and 16. The central portion 18 may be folded over and stitched to produce a cord or rope effect. In the illustrated embodiment, the cross-section of the central portion 18 is generally rectangular. However, it can be appreciated that the central portion 18 can have many configurations, such as, for example, a cord of generally circular cross-section.

Figure 3:
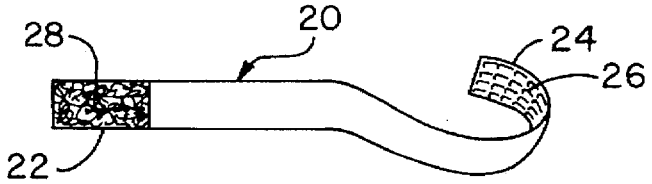
FIG. 3 is a front view of one embodiment of the strap member of the device of FIG. 1.

As shown in FIG. 1, the device 10 also includes a strap member, generally indicated at 20, which is constructed and arranged to be fitted around an arm portion of the user generally adjacent the elbow of the user. The preferred embodiment of the strap member 20 is shown in FIG. 3, wherein the strap member is generally an elongated member, preferably made of nylon and having opposing ends 22 and 24. End 24 includes hook structure 26 on a surface thereof, which cooperates with loop structure 28 at a surface of end 22. Thus, the strap member may be quickly fastened and unfastened in a conventional manner around the arm of the user.

Figure 4:
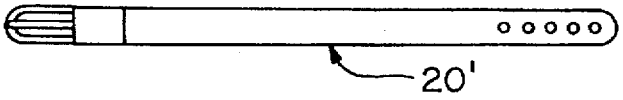
FIG. 4 is a front view of another embodiment of the strap member of the device.

FIG. 4 shows an alternative embodiment of the strap member 20'. As shown, instead of providing the hook and loop type fastening structure, a conventional belt buckle arrangement is provided.

As shown in FIG. 1, a coupling structure, generally indicated at 30, is provided which couples the strap member 20 to the central portion 18 of the belt structure 12. In the illustrated embodiment, the coupling structure 30 is in the form of a conventional, double swivel connector. The swivel connector 30 is preferably steel and includes first and second opposing closed loop members 32 and 34, respectively, which are joined by a swivel connecting pin 36 such that each loop member 32 and 34 may swivel or rotate about pin 36. As shown in FIG. 1, the central portion 18 of the belt structure is fitted through the loop 32 while the strap member 20 is fitted through the loop 34. Thus, it can be appreciated that the strap member 20 may slide freely with respect to the central portion 18 of the belt structure via the coupling structure 30. The swivel connector has an overall length of approximately one inch, the function of which will become apparent below.

Figure 5:
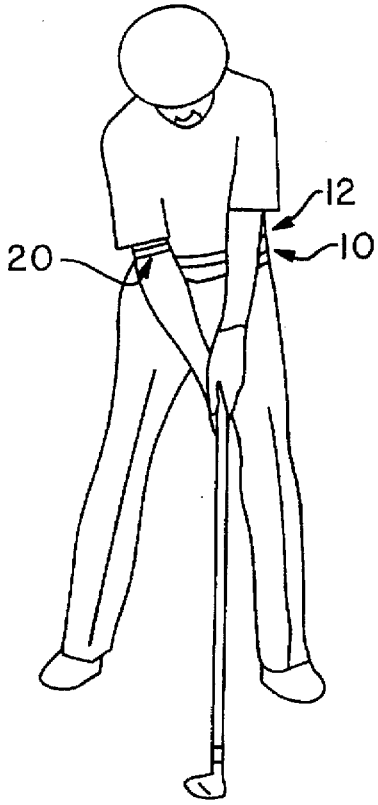
FIG. 5 is a view of a golfer shown wearing the device of FIG. 1, initially addressing a golf ball.
Figure 6:
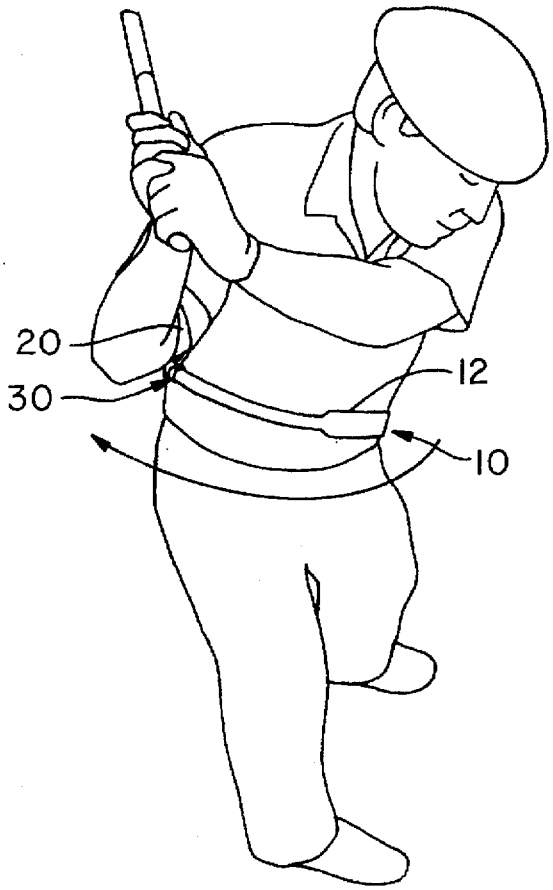
FIG. 6 is a view of a golfer shown wearing the device of FIG. 1, during the back swing of a golf swing.
Figure 7:
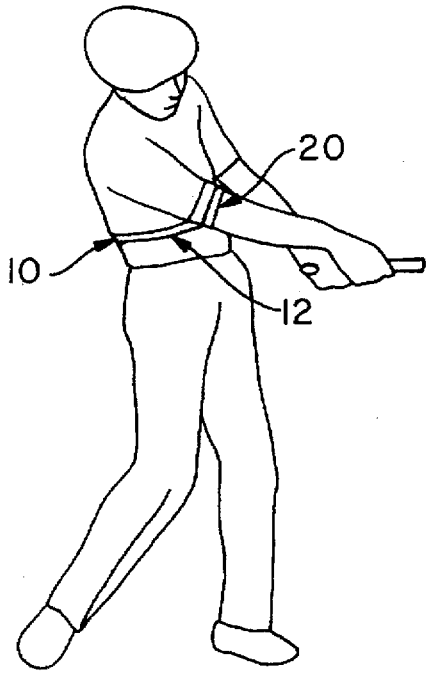
FIG. 7 is a view of a golfer wearing the device of FIG. 1 during the follow through of the golf swing.

The operation of the device 10 will be appreciated with respect to FIGS. 5–7. As shown in FIG. 5, the belt structure 12 is first fixed about the waist of the user, and the strap member 20 is then coupled to the arm of the user, generally adjacent the elbow. The buckle or ends of the belt may be rotated about the waist so as to be generally adjacent the back of the golfer. This enables the central portion 18 to be located generally around the side and front portion of the golfer. During the back swing, as shown in FIG. 6, the strap member 20 will slide along a plane defined by the central portion 18 due to the coupling structure 30, in the form of the double swivel connector. Due to the length of the coupling structure 30, the movement of the user's elbow during the back swing and at the top of the back swing is restricted from moving upwardly. The strap member 20 basically locks the elbow in place. During the downswing, the strap member 20 slides along the plane defined by the central portion 18 keeping the right elbow generally adjacent the hip or waist of the golfer as shown in FIG. 7. Although the device 10 is shown being used by a right-handed golfer, a left-handed golfer may use the device 10 by simply placing the strap member 20 on the left arm.

It can be appreciated that the use of the golf training device 10 insures a proper take away since the device 10 requires the golfer to take the club back on an inside path. Because the elbow is locked in place by the strap member 20, it is impossible to take the club back along an outside path.

The device 10 insures the proper shoulder and hip turn. A common problem for many golfers is forgetting to turn the shoulders and hips and thus use only the arms during the swing. The device 10 will not allow this to happen. As soon as the golfer tries an arm swing without turning, the device 10 pulls at the hip.

The device 10 provides the proper weight shift because the wearer of the device 10 has to turn his shoulders in order to swing the club. Thus, it is extremely hard to perform a reverse weight shift while using the device 10. As the left shoulder turns to the right, the weight must also shift to the right.

The device 10 permits the proper position of the club and body. Since the golfer has to take the club back inside, must turn properly, must shift the weight to the right and is able to stop at parallel, it stands to reason that the club will be much easier to control in relation to position.

The device 10 provides the proper drop into the slot and club angle in relation to the body and it prevents "hitting from the top". Once the back swing is complete, the drop into the slot with the downward pull using the body, is natural with the device 10. This is where the club head speed is generated. If a hit from the top is attempted, the golfer will receive a pull at the hip and elbow by the device 10.

The device 10 provides the proper angle of the club to body at impact. Due to the double swivel connection, the right arm is permitted to pass around, but close to the body and thus, a "perfect swing" is achieved.

According to the rules of golf, the device 10 could not be used during an actual round of golf. However, as a training tool, it is envisioned that the device 10 would be used at the driving range. Further, prior to initiating a round of golf, the device 10 can be slipped on for a warm-up routine. By wearing the device 10 during the warm-up, the swing practice will be proper and the user will be able to initiate the round of golf with increased confidence.

Further, many golfers tend to start a round of golf strongly, hitting the ball well, only to lose their swing half-way through the round. The device 10 could be slipped on while the golfer is waiting on the group in front of him and take a few practice swings. The device 10 will immediately indicate to the golfer why he is swinging incorrectly.

It can be seen that the device 10 of the present invention provides an effective training means for producing a "perfect golf swing".

While the invention has been described in connection with what is presently considered to be the most practical and preferred embodiment, it is understood that the invention is not limited to the disclosed embodiment but, on the contrary, is intended to cover the various modifications and equivalent arrangements included within the spirit and scope of the appended claims.

What is claimed is:

1. A golf swing training device comprising:

a belt structure having end portions constructed and arranged to be joined to fix the belt structure around a waist of a user, said belt structure having a central portion between said end portions, said central portion extending in substantially parallel relation with respect to a belt-line of said user and across the entire front portion of the user;

a strap member constructed and arranged to be fitted around an arm portion of the user generally adjacent an elbow of the user; and a coupling structure coupling said strap member to said central portion of the belt structure and constructed and arranged to restrict generally upward movement of said strap member with respect to said central portion yet permit sliding motion of said strap member along said central portion such that during a back swing of a golf swing, said strap member may slide in one direction unimpededly along said central portion across the entire front portion of the user in parallel relation to said belt-line and during the down swing of the golf swing, the strap member may slide unimpededly along the central portion across the entire front portion of the user in parallel relation to said belt-line and in a direction opposite said one direction, with said strap member controlling movement of the elbow of the user so as to keep the elbow generally adjacent the waist of the user during the golf swing, wherein said coupling structure comprises a double swivel connector, said connector having first and second opposing loop members and a swivel connection member between said loop members, said central portion of said belt structure passing through said first loop member and said strap member passing through said second loop member; and wherein said double swivel connector is constructed and arranged to permit each of said first and second closed loop members to freely and independently rotate with respect to said swivel connection member about a longitudinal axis of said swivel connection member.

2. The device according to claim 1, wherein said ends of said belt structure include a buckle arrangement for joining said ends.

3. The device according to claim 1, wherein said strap member includes a buckle arrangement for joining ends thereof.

4. The device according to claim 1, wherein said ends of said strap member include hook and loop structure thereon for joining said ends thereof.

5. The device according to claim 1, wherein said belt structure and said strap member are made of nylon.

6. The device according to claim 1, wherein said double swivel connector has a length of approximately one inch.

7. The device according to claim 1, wherein said double swivel connector is made of steel.

8. A method of performing a golf swing utilizing a golf training device, said method comprising the steps of:

providing a golf training device including a belt structure having end portions constructed and arranged to be fixed around the waist of a user, the belt structure having a central portion between the end portions thereof; a strap member constructed and arranged to be fitted around an arm portion of the user generally adjacent the elbow of the user; and coupling structure coupling the strap member to the central portion of the belt structure, wherein the coupling structure comprises a double swivel connector, the connector having first and second opposing loop members and a swivel connection member between the loop members, the central portion of the belt structure passing through the first loop member and the strap member passing through the second loop member, and wherein the double swivel connector is constructed and arranged to permit each of the first and second closed loop members to freely and independently rotate with respect to the swivel connection member about a longitudinal axis of the swivel connection member;

securing the belt structure around the waist of the user;

securing the strap member around an arm of the user generally adjacent the elbow; and performing a golf swing by initiating a back swing whereby the strap member slides in a first direction unimpededly along the central portion of the belt structure substantially in a plane parallel to the user's belt-line with the strap member restricting generally upward movement of the elbow and during the down swing, the strap member slides unimpededly and parallel to the user's belt-line along the plane in a direction opposite the first direction such that the elbow is kept generally adjacent the waist of the user.

* * * * *